United States Patent [19]

Felling

[11] Patent Number: 5,015,032

[45] Date of Patent: May 14, 1991

[54] CHAISE LOUNGE WITH ADJUSTABLE CANOPY

[76] Inventor: Gerald J. Felling, 230 Arroyo Rd., P.O. Box 294, Lagunitas, Calif. 94938

[21] Appl. No.: 496,520

[22] Filed: Mar. 20, 1990

Related U.S. Application Data

[63] Continuation-in-part of Ser. No. 482,190, Feb. 20, 1990, which is a continuation-in-part of Ser. No. 385,057, Jul. 26, 1989, abandoned.

[51] Int. Cl.[5] ..... A47C 7/62

[52] U.S. Cl. ..... 297/184; 297/306

[58] Field of Search ..... 297/184, 306; 135/96

[56] References Cited

U.S. PATENT DOCUMENTS

| | | | |
|---|---|---|---|
| 2,243,984 | 6/1941 | Singlwald | 297/184 X |
| 4,790,598 | 12/1988 | Locher | 297/325 |

FOREIGN PATENT DOCUMENTS

| | | | |
|---|---|---|---|
| 434019 | 7/1925 | Fed. Rep. of Germany | 297/184 |
| 489094 | 12/1929 | Fed. Rep. of Germany | 297/184 |
| 583596 | 1/1925 | France | 297/184 |
| 293675 | 10/1953 | Switzerland | 297/184 |

*Primary Examiner*—Laurie K. Cranmer

*Attorney, Agent, or Firm*—Phillips, Moore, Lempio & Finley

[57] ABSTRACT

A chaise lounge, usable for sunbathing and other recreational purposes, comprises a stationary base having a normally upright canopy pivotally mounted rearwardly thereon. The canopy, preferably comprising a hood-like frame covered with an open mesh and flexible material, is adapted to be pivoted beween a normal upright position to form a seating arrangement and a lowered position placing a back of the canopy in alignment with a top of the base. A pair of laterally spaced and operator-controlled (from within the canopy) combined holding and locking struts are pivotally interconnected between forward ends of each side of the canopy and a respective side of the base to releasably hold and lock the canopy in a selected position between its upright and lowered positions. Each strut may comprise a releasable coil spring for selectively holding a reciprocal rod in a locked position, under torsional friction, or a motor-driven screw drive arrangement. In a preferred embodiment of this invention, a pair of laterally spaced combined cushioning and return struts are pivotally interconnected between each side of the canopy and the frame to cushion and control movement of the canopy when it is moved from its upright position towards its lowered position and for automatically moving the canopy back to its upright position in response to release of the holding and locking struts.

18 Claims, 3 Drawing Sheets

CHAISE LOUNGE WITH ADJUSTABLE CANOPY

CROSS-REFERENCE TO RELATED APPLICATIONS

This application is a continuation-in-part of U.S. patent application Ser. No. 07/482,190 filed on Feb. 20, 1990 for "Sheltered Lounge Chair" which, in turn, is a continuation-in-part of U.S. patent application Ser. No. 07/385,057, filed on July 26, 1989, now abandoned.

TECHNICAL FIELD

This invention relates generally to a recreational and vacational seating and lounging arrangement and more particularly to a chaise lounge having an adjustable canopy, including a backrest, adapted to be locked in an infinite number of positions between its upright and lowered positions.

BACKGROUND OF THE INVENTION

Chaise lounges, having canopies mounted thereon, have found widespread recreational and vacational use, particularly at beaches and on the sun decks and patios of homes and hotels. However, the backrest for this type of lounge, popular in Europe, is often-times fixed in position. Thus, the user is unable to adjust the backrest for his or her comfort. The lounge was later modified to permit the backrest to pivot on the lounge. However, the externally operated mechanical locking systems utilized are difficult to manipulate and the substantial weight of the backrest (e.g. 75 lbs.) renders the lounge impracticable for every day use.

U.S. Pat. Nos. 2,243,984; 2,279,748 and 2,837,140 discloses various types of beach chairs wherein an adjustable backrest or canopy is pivotally mounted on a frame to adjust the inclination of the backrest from an upright position to a lowered position. Chairs of this type normally rely on legs or struts, positioned rearwardly of the pivot point whereat the backrest pivots on the frame, for supporting the weight of the person sitting or lying thereon.

Further, recreational lounges and chairs of the above-described types do not provide means for automatically returning the backrest to its upright position, under control of the person sitting in the chair. The adjustment and seating problems encountered with conventional chairs of these types are aggravated when the covering material for the canopy thereof comprises an open mesh, flexible material which will not exhibit the desired support to the person lying thereon should conventional support systems be utilized for supporting the backrest at its lowered position.

SUMMARY OF THE INVENTION

An object to this invention is to provide ar improved and easily adjusted chaise lounge useful for a wide variety of recreational and vacational purposes The lounge is particularly adapted for optionally providing full sun bathing or sun and wind protection at the convenience of the user.

The chaise lounge of this invention comprises a stationary base frame having laterally spaced and vertically disposed sides and a horizontally disposed top adapted to retain a seating cushion thereon. A normally upright canopy frame comprises laterally spaced and vertically disposed sides, a top and a normally upright back, all secured together to form a hood or cowl. A rearward end of each of the sides of the canopy frame are pivoted rearwardly on the base frame to permit the canopy frame to be moved through an infinite number of positions between its normal upright position and its lowered position, placing the back of the canopy frame in at least general horizontal alignment with the top of the base frame. Combined holding and locking means are pivotally interconnected between a lower and forward end of each side of the canopy frame and a respective side of the base frame to releasably hold and lock the canopy frame in a selected position between its upright and lowered positions.

As described more fully hereinafter, the holding and locking means are each preferably uniquely positioned, relative to the pivot points whereat the canopy frame is mounted on the base frame. This unique positioning desiderata ensures that the center of gravity of the upholstered and completed canopy, including any weight imposed thereon by a person sitting in the lounge, will place the holding and locking means in tension when the center of gravity moves rearwardly of such pivot points Conversely, the holding and locking means will be placed in compression when the center of gravity moves forwardly of such pivot points, i.e., when the canopy is moved back to its normal, upright position.

Also in the preferred embodiment of this invention, combined cushioning and return means are pivotally interconnected between each side of the canopy frame and the base frame for cushioning movement of the canopy frame when it is moved from its upright position to its lowered position. In addition, such means functions to automatically move the canopy frame from its selected position, back to its upright position in response to operator or user release of the holding and locking means from internally within the canopy.

Further, the preferred embodiment of this invention includes an open mesh and flexible covering for the canopy which ensures air ventilation for the person using the lounge and also provides a comfortable backrest and structurally integrated suspension for the backrest when it is horizontally disposed to form a bed-like or "sunning" arrangement.

The combined holding and locking means is described as either comprising a rod slidably mounted in a pair of releasable coil springs that normally function to apply torsional friction to the rod to hold it in a selected locked position or a motor-driven gear arrangement.

BRIEF DESCRIPTION OF THE DRAWINGS

Other objects and advantages of this invention will become apparent from the following description and accompanying drawings wherein.

DESCRIPTION OF THE PREFERRED EMBODIMENTS

General Description

Figure 1:
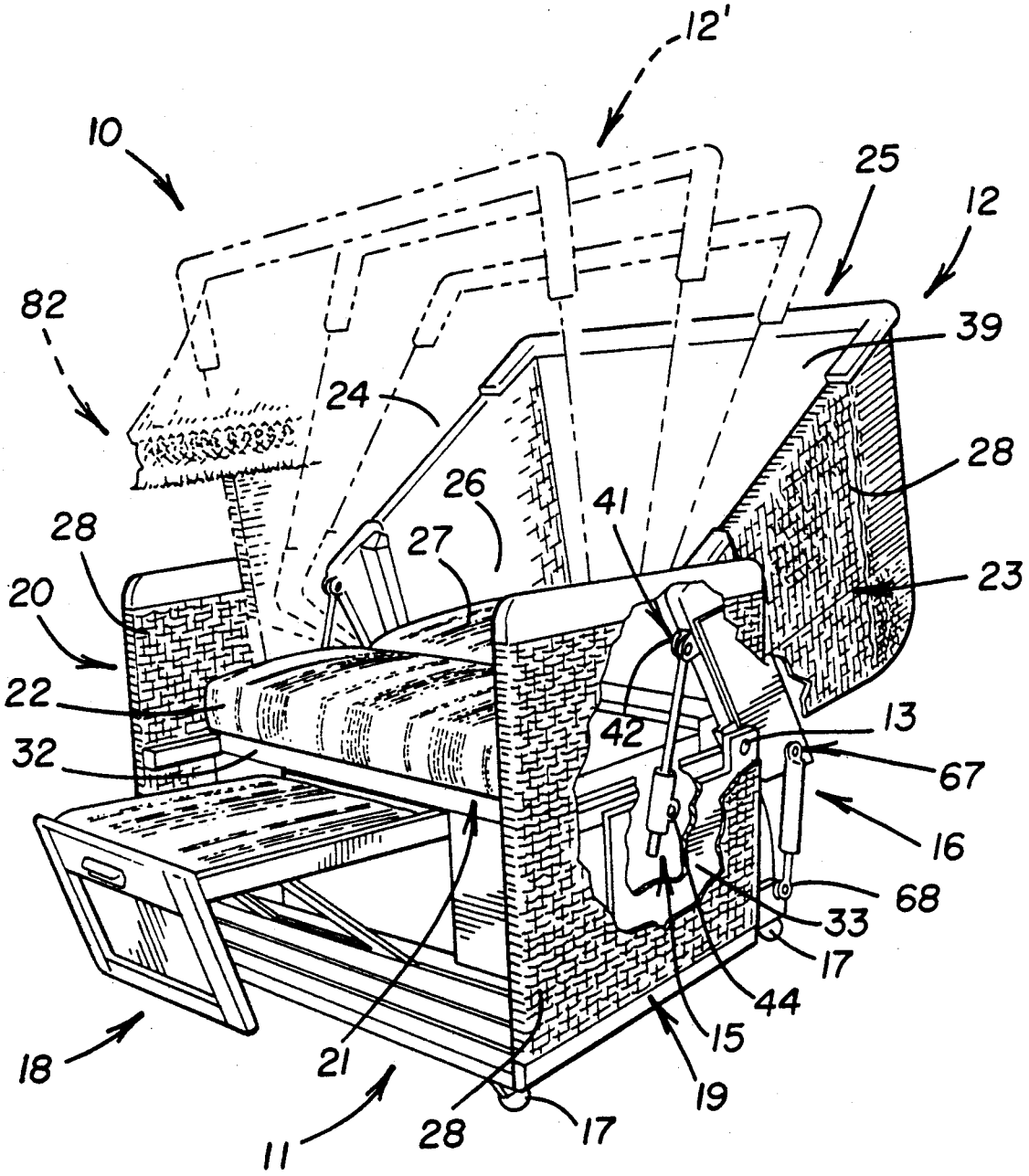
FIG. 1 is a partially sectioned frontal perspective view of a chaise lounge embodying this invention with a canopy thereof shown in its fully lowered position and further showing various raised positions of the canopy in phantom lines.
Figure 2:
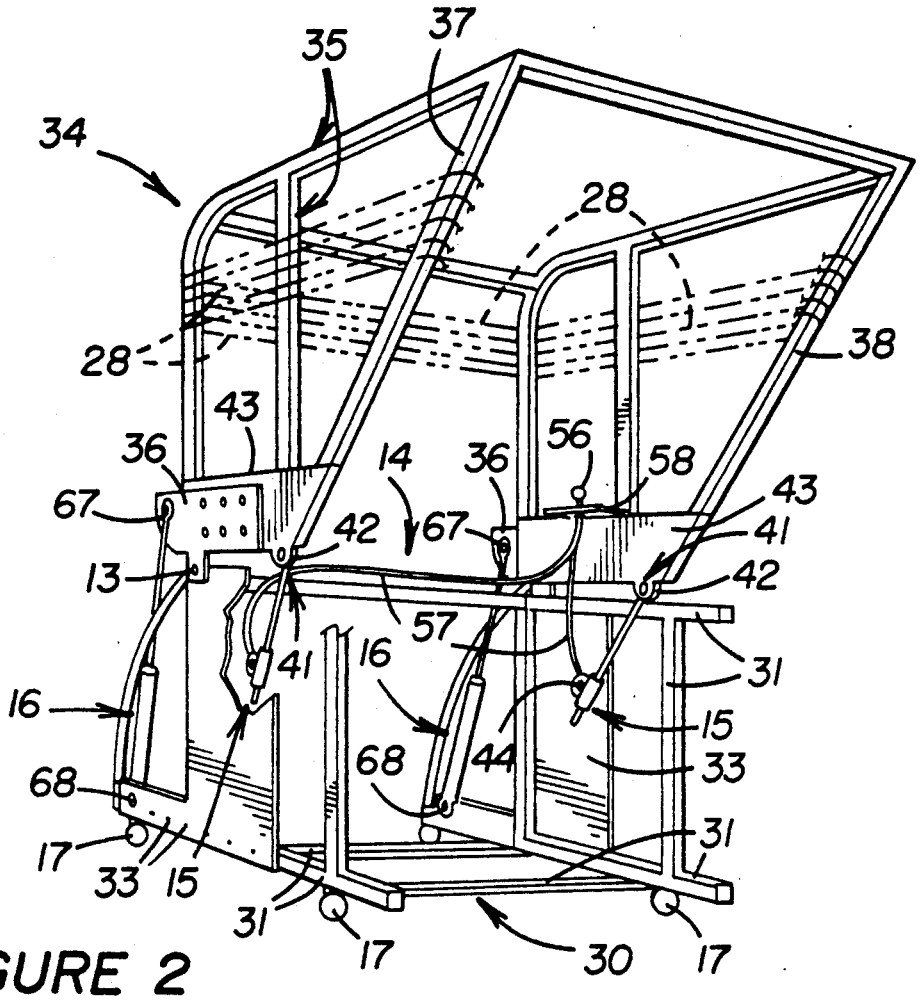
FIG. 2 is a partially sectioned frontal perspective view illustrating the pivoted mounting of a canopy frame on a stationery base frame of the lounge and further illustrating a pair of combined holding and locking struts and a pair of combined cushioning and return cylinders or struts, pivotally interconnected between the canopy and base frames.

Referring to FIGS. 1 and 2, a chaise lounge 10 comprises a base 11 having a canopy 12 pivotally mounted rearwardly thereon by laterally spaced and aligned pivot pins 13 (one shown). As shown in FIG. 1, the canopy is adapted to be selectively pivoted, under control of the user, from its normal upright position, forming a seating arrangement, to its illustrated full line lowered position forming a bed-like or "sunning" arrangement. As described more fully hereinafter, a hand-controlled cable system 14 (FIGS. 2 and 4) is adapted to release a pair of laterally spaced combined holding and locking means, shown in the form of struts 15 pivotally interconnected between base 11 and canopy 12, to selectively move and hold the canopy in any one of an infinite number of positions between its normal upright and lowered positions.

In the preferred embodiment of this invention, a pair of laterally spaced combined cushioning and return means, shown in the form of struts or cylinders 16, are pivotally interconnected between base 11 and canopy 12 to cushion movement of the canopy when it is moved from its upright position towards its lower position. Cylinders 16 further function to automatically move the canopy back to its upright position in response to release of locking struts 15. Each corner of base 11 can be mounted on a standard caster 17 to facilitate movement of the lounge into various orientations for sun bathing, viewing or similar recreational delights. A standard collapsible and storable leg and foot rest 18 can be suitably mounted on the frontal side of base 11 for convenience of the user.

Base 11 comprises laterally spaced and vertically disposed opposite side panels 19 and 20 and a horizontally disposed top or seat panel 21, adapted to retain a seating cushion 22 thereon. The canopy comprises laterally spaced and vertically disposed sides 23 and 24, a top 25 and a normally upright back 26, adapted to have a back cushion 27 mounted thereon. Thus, when canopy 12 is moved to its fully lowered position illustrated in FIG. 1, back 26 of the canopy and top 21 of the base, as well as cushions 22 and 27, are placed in at least general horizontal alignment, relative to each other, to form the bed-like or "sunning" arrangement for the user.

In the preferred embodiment of this invention, the sides, top and back of the canopy are preferably covered with a woven, flexible material 28 to provide air ventilation through the canopy for convenience of the user. As described hereinafter, the woven material, underlying back cushion 27, is suspended from a frame of the canopy to provide the canopy with a high degree of structural integrity and the desired amount of flexibility. Applicant has discovered, through experimentation, that it is highly desirable to pivotally connect holding and locking means 15 to canopy 12, forwardly of pivots 13, to avoid a "spongy" effect felt by the user should the struts be positioned rearwardly of such pivot connection.

Detailed Description

Referring to FIG. 2, it should be first noted that the components and constructions on opposite sides of lounge 10 are substantial mirror images of each other. Base 11 comprises a base frame 30 composed of a plurality of wooden frame numbers 31 suitably secured together to form a box-like rigid construction having an open front side. A horizontally disposed sub-cushion 32 can be suitably mounted on a horizontally disposed rigid plywood panel (not shown), secured within the base frame to support seat cushion 22 therein (FIG. 1). Steel plates 33 are suitably secured on opposite sides of the base frame to increase the structural integrity thereof and to mount the lower ends of struts 15 and 16 thereon, as described below.

Canopy 12 comprises a canopy frame 34, also formed by a plurality of structurally integrated wooden frame members 35 that form the rigid skeleton frame for contiguous sides 23 and 24, top 25 and back 26 of the canopy (FIG. 1). A steel plate 36 is suitably secured to the lower end of each side of canopy frame 34 to provide structural reinforcement thereat and to pivot the upper end of each cushioning and return strut 16 thereon, as also described more fully hereinafter. As suggested above, canopy frame 34, as well as the sides and back panels of base frame 30, are preferably covered with a woven fabric 28 to provide sun and wind protection for the user, sufficient ambient air ventilation within the canopy for comfort purposes and a structurally sound suspension system for the backrest of the canopy.

Figure 3:
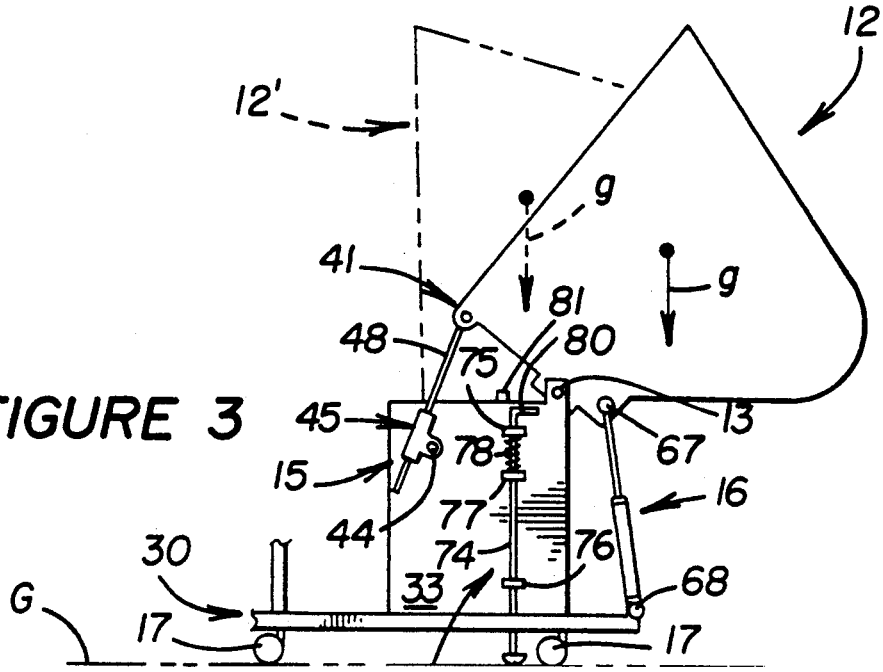
FIG. 3 is a side elevational view schematically illustrating the canopy in its fully lowered position on the base frame to depict a shifting of its center of gravity when the canopy is lowered from its normal upright position.

FIG. 2 partially illustrates a portion of woven material 28 in phantom lines which is suspended between parallel frontal side rails 37 and 38 of the canopy to provide a hammock-like suspension on the torso of the user when the canopy is in its fully lowered or down position (FIG. 3). The material may be formed as a standard basket weave composed of rattan, vinyl or the like. Alternatively, certain lounge applications may find it advantageous to utilize a strong canvas or nylon mesh material for this purpose. A porous liner 39 (FIG. 1) may be secured within the canopy, if so desired.

Laterally spaced and laterally aligned pivot pins 13 (one shown in FIG. 2) pivotally mount rearward ends of the sides of canopy frame 34 on the rearward and upper ends of the sides of base frame 30 at steel plates 33. Thus, the canopy frame is permitted to move through an infinite number of positions between its normal upright position (FIG. 2), forming a seating arrangement, and its lowered position (FIG. 1), placing the back of the canopy frame at least approximately horizontally and in at least general alignment with the top of base frame 30.

As shown in FIG. 3, a center of gravity "g" is positioned substantially rearwardly of pivot pins 13 when the canopy frame is maintained at its fully lowered position. As further shown in FIG. 3, when the canopy frame is fully raised to its upright position 12', shown in phantom lines, the center of gravity will shift leftwardly and will be positioned forwardly of pivot pins 13. This arrangement ensures that the weight of the canopy (e.g., 75 lbs.), as well as the weight of the torso of the person lying in the canopy when it is fully lowered, will be substantially supported by the pivot pins and steel plates 33.

Otherwise stated, the moment arms between the shifting center of gravity and pivot pins 13 will be maintained within acceptable limits to ensure maximum support of the canopy and person lying therein. In addition, struts 16 are uniquely arranged to aid in the supporting function by being placed in tension when the center of gravity of the canopy is positioned rightwardly of pivot pins 13 (FIG. 3). Conversely, the struts are placed in compression when the canopy is raised to place the center of gravity forwardly of pivot pins 13.

As briefly discussed above, the experimental positioning of struts 15 rearwardly of pivot pins 13 (e.g., generally in the vicinity of struts 16) was found inadequate to provide the required weight supporting desiderata. Positioning of struts 15 in this discarded manner also exhibited an uncomfortable "spongy" feeling when back 26 (FIG. 1) of the canopy was maintained in its lowered, horizontal bed position with the load of a person's body being imposed thereon. This phenomena was found to be primarily occasioned by the substantial cantilevered effect provided by the substantial over-hang of the canopy, rearwardly of pivot pins 13, and the relatively close positioning of the struts to the pivot pins.

Applicant has found that placement of his combined holding and locking struts 15 at least approximately in the manner illustrated provides for a substantial degree of structural integrity and efficient operation of the lounge when the canopy is pivoted to various positions on base 11. In particular, each strut 15 is pivotally interconnected, forwardly of pivot pins 13, between a lower forward end of each side of canopy frame 34 and a respective side of base frame 30. As shown in FIGS. 1 and 2, each strut 15 is pivotally connected by a standard ball and socket connection 41 on a bracket 42 secured beneath a reinforcement rail 43, defining a lower end of each side of canopy frame 34. As described more fully hereinafter, the mid-portion of each strut 15 is pivotally connected by a ball and socket connection (or pin) 44 on the inner side of steel plate 33 with the pivot connection being positioned approximately intermediate the height and width of each side of base frame 30.

Figure 4:
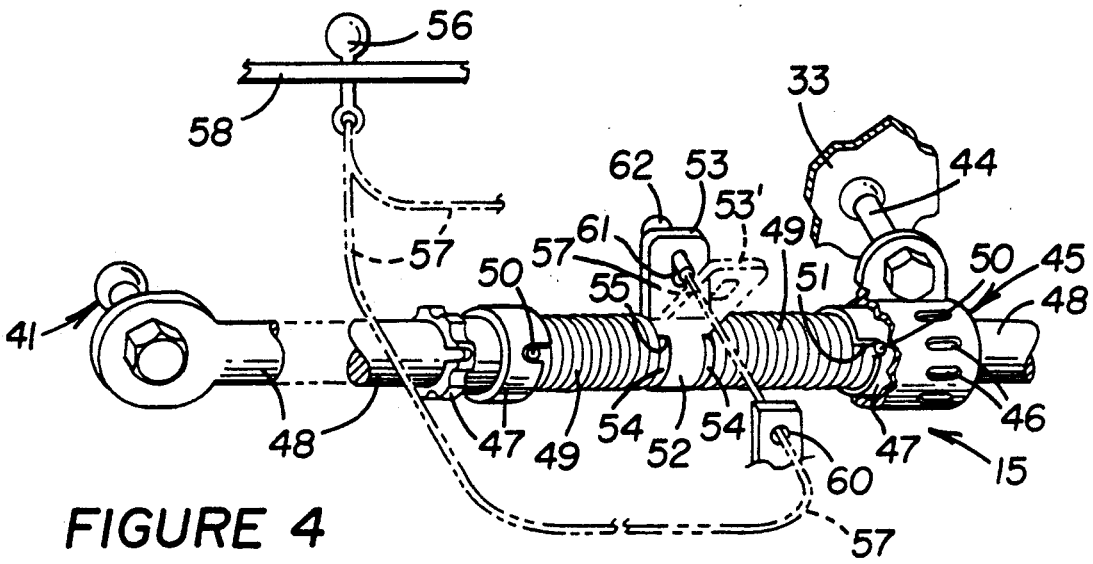
FIG. 4 schematically illustrates a combined holding and locking strut and its mechanical attachment to an operator-controlled cable system for selectively releasing the strut to permit pivotal adjustment of the canopy.

Referring to FIG. 4, each strut 15 comprises a partially illustrated tubular housing 45 suitably swaged at 46 onto a pair of identical and longitudinally spaced collars or bushings 47. A rod 48 is reciprocally mounted in the bushings and housing and has a pair of torsion coil springs 49 mounted thereon. One end of the rod is pivotally mounted on canopy frame 34 at pivot connection 41 whereas the opposite end of the rod remains free of attachment (FIG. 1). A distal end 50 of each spring is captured within a slot 51, defined on an inner end of a respective bushing 47. A centrally disposed collar 52 is rotatably mounted on rod 48 and has an actuation lever 53 extending radially outwardly therefrom.

A proximal end 54 of each spring is captured within a slot 55 defined in collar 52. Thus, rotation of lever 53 to its phantom-line or release position 53' and against the helix directions of the coil springs will expand their mean diameters to release torsional friction on the rod to permit it to reciprocate therein. When lever 53 is in its normal full line "locked" position, the coils of the springs will contract automatically to frictionally grip rod 48 and thus hold and lock the rod and canopy 12 in a selected position.

Referring to FIGS. 2 and 4, cable system 14 comprises a schematically illustrated operator-controlled reciprocal handle (or slide button) 56, adapted to selectively and simultaneously reciprocate a pair of flexible cables 57 to release the frictional gripping forces imposed on rods 48 by springs 49 of struts 15. Handle 56 is suitably mounted on a plate 58, mounted on an inner side of sidewall 23 (or 24) within canopy 12, as schematically shown in FIG. 2. The standard cables are suitably guided by brackets (not shown) secured on base frame 30 and canopy frame 34 to ensure that a pulling of the cables will function to unlock struts 15.

Referring again to FIG. 4, a distal end of each cable 57 extends through a slot formed through a bracket 60 secured on housing 45 and further extends through a slot 61 formed in lever 53 and is anchored thereon. Thus, pulling of cable 57 will engage an enlarged terminal end 62 of the cable behind the lever to pivot the lever for release of the strut. In particular, when the lever is rotated by the cable to its phantom-line position 53', it will rotate collar 52 generally clockwise in FIG. 4 to release the gripping force of spring 49 on rod 48.

Housing 45, pivotally mounted on plate 33 by pin or ball and socket connection 44, will pivot on the connection to compensate for relocation of the canopy to its selected position. Further detailed description of strut 16 and its attendant actuating mechanisms can be found in U.S. Pat. No. 3,874,480. These types of struts can be purchased from P.L. Porter Company of Woodland Hills, Calif. under its Model No. MM65-1016 (Mechlok).

Figure 6:
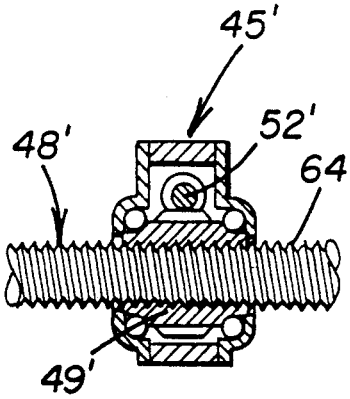
FIG. 6 a sectional view, generally taken in a direction of arrows VI—VI in FIG. 5.
Figure 5:
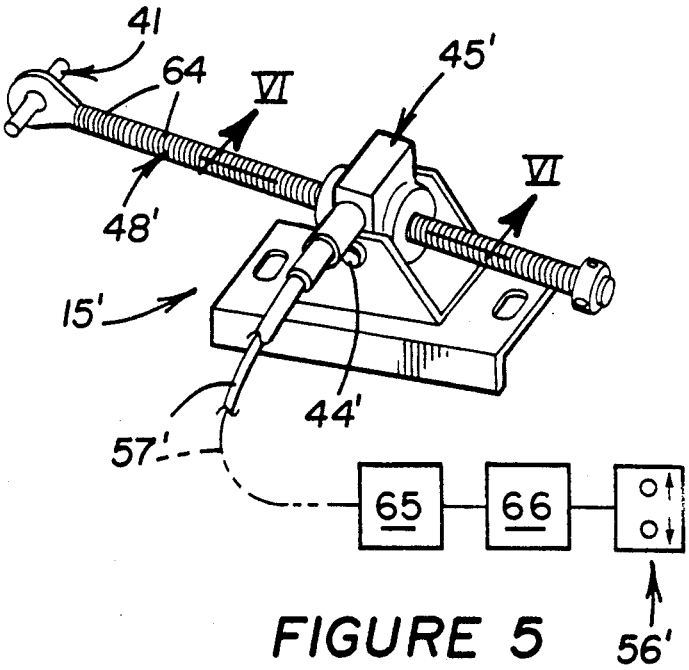
FIG. 5 illustrates an alternative combined holding and locking mechanism, including a motor-driven gear arrangement.

FIGS. 5 and 6 illustrate an alternative combined holding and locking means 15' wherein components and constructions generally corresponding in function to those described above are depicted by identical numerals, but with numerals in FIGS. 5 and 6 being accompanied by prime symbols (').

Combined holding and locking means 15' comprises a threaded rod 48' adapted for axial movement in a housing 45', under control of an operator switch 56' mounted in canopy 12 in a manner similar the mounting of handle 56 in FIG. 2.

As shown in FIG. 6, rod 48' comprises a plurality of spiral teeth 64 adapted to be engaged by internal and meshing teeth of a gear 49'. Gear 49' is rotatably mounted by axially spaced annular bearings in housing 45' and has external teeth meshed with external teeth of a gear 52'. Gear 52' is secured to the distal end of a cable 57'. Thus, rotation of the gear in FIG. 6 will rotate gear 49' and move rod 48' axially in opposite directions, depending on the direction of rotation of gear 52'.

One end of rod 48' has an eyelet adapted to be pivotally mounted on pin 41 (or by a ball and socket pivot connection) to pivot the canopy of base 11 in the manner described above. A pivot connection (pin or ball and socket) 44' pivotally mounts housing 45' on a bracket adapted for securance to plate 33 (FIG. 1) to place the pivot axes of pins 41 and 44' in parallel relationship and positioned similar to pins 41 and 44. Operator-control switch 56' has a pair of buttons thereon to selectively activate a reversible electrical motor 65 to, in turn, rotate flexible cable 57' (similar to a speedometer cable on an automobile) and gear 52' in its selected direction. A standard rechargeable battery pack 66 can be mounted in the base of the lounge, along with fractional horsepower motor 65.

Figure 7:
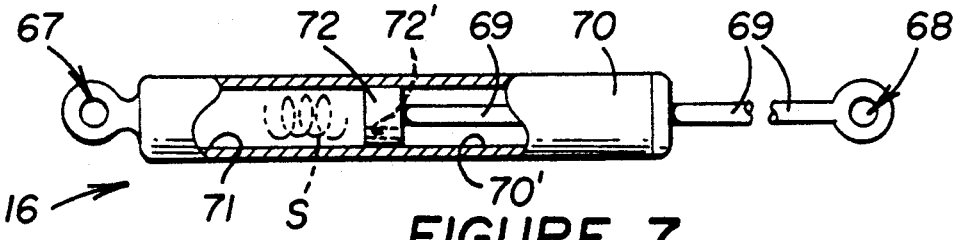
FIG. 7 is a partially sectioned view schematically illustrating a combined cushioning and return spring strut employed in the lounge to cushion movement of the canopy when it is moved to a lowered position and for automatically moving the canopy back to its upright position in response to operator-release of the holding and locking struts.

FIG. 7 schematically illustrates combined cushioning and return means or strut 16. Each strut is pivotally interconnected, rearwardly of pivot pins 13, between each side of canopy frame 34 and base frame 30 by ball and socket pivot connections (or pins) 67 and 68, respectively (FIGS. 1–3). As further shown in FIG. 7, the strut comprises a rod 69 reciprocally mounted in a tubular housing 70. A standard compression coil spring S (shown by phantom lines) could be mounted in a spring and damping chamber 71, between a piston head 72 and the left end of the housing to provide the basic spring dampening and return functions of the strut. However, when the canopy is moved toward its lowered position it is preferable to utilize a standard gas over oil cylinder or strut to more closely provide a controlled and modulated spring force applied between the rod and housing. This will insure that the canopy will return to its upright position smoothly and slowly, when struts 15 are released from their locked conditions of operation.

The gas-oil cylinder or strut is designed to permit a normal moving force to lower the canopy, upon release of locking struts 15, towards its selected lowered position. The struts will exhibit sufficient force to move the canopy back to its upright position in a smooth and controlled manner when the locking struts are again released in the above-described manner. Struts 16 may have either their rod end (FIG. 2) or head end (FIG. 1) pivotally connected to canopy frame 34, depending on preference of the designer. The standard strut may be of the "Type 16" manufactured by SUSPA, Incorporated of Grand Rapids, Mich.

As schematically shown in FIG. 7, struts of this type may include an annular chamber 70' defined in housing 70 and one or more orifices 72' formed through piston head 72 for communicating oil from chamber 71 to chamber 70'. A nitrogen gas is retained in the head end of chamber 71 to function as a spring when the strut is retracted and to expand when the strut is extended. Orifice 72' (one or more of which can have a standard check valve therein to return oil to chamber 70') will function in a conventional manner to closely control the metering of oil into chamber 71 when the strut is retracted.

Standard struts or gas cylinders of this type have closely controlled calibration that will avoid the more abrupt return of the canopy to its upright position, normally encountered with the standard type of coil-spring strut. In particular, the relatively flat force curve, controlled forces and extension speed, combined with damping at the end of the stroke, are characteristic of advantages gained with use of the gas-oil strut. The conventional strut essentially includes a specific oil quantity, which serves as a lubricant and damping medium, and nitrogen gas that compresses in the cylinder in the manner described above. Each strut or gas cylinder 16 was designed to apply graduated nominal lifting or "hand forces" to canopy 12, including 23.1 lbs. (fully lowered at a 90° tilt from upright), 1.3 lbs. (60° tilt), 20.9 lbs. (30° tilt) and 37.5 lbs. (fully upright).

As schematically shown in FIG. 3, a releasable spring-biased holding mechanism 73 can be suitably mounted on one side of base frame 15 to normally hold the lounge against rolling on casters 17. The mechanism comprises a vertically disposed rod 74 reciprocally mounted in a pair of brackets 75,76, each secured on a side and rearwardly on the base frame. The rod has a washer 77 secured thereon and a compression coil spring 78 is mounted on the rod between upper bracket 75 and washer 77. The spring normally biases a rubber foot pad 79, secured to a distal end of the rod, into frictional engagement with ground or patio surface G.

Thus, the mechanism will normally hold the lounge against movement, until released. The proximal end of rod 74 terminates at a handle 80 positioned at the backside of the lounge in an exposed location between adjacent sides 19 and 23 of base 11 and canopy 12, respectively. Thus, when the handle is pulled upwardly in FIG. 3, foot pad 79 will release its hold on ground G to permit the lounge to be moved. A standard lock-plate 81 can be secured on the base, above bracket 75, to releasably hold the rod in its raised position when handle 77 is rotated and placed thereon.

It should be understood that other modifications can be made to the lounge without departing from the scope of this invention, as covered by the appended claims. For example, the majority of the lounge's components could be formed from a high-impact and wear-resistant plastic material. The components could be molded in modular form to facilitate production assembly and repair of the lounge, if needed. Also, sides 23,24 and top 25 of canopy 12 could be suitably hinged together to form a "knock-down" canopy, storable within the confines of base 11 for shipping purposes. As shown by phantom lines in FIG. 1, a sun shade 82 could be swingably mounted in a conventional manner on the forward and upper side of canopy 12 to selectively provide additional shade for a person when the canopy is in its upright position.

I claim:

1. A sheltering lounge chair usable for sun bathing and the like comprising a base frame having laterally spaced and vertically disposed sides and a horizontally disposed top adapted to retain a seating cushion thereon, a normally upright canopy frame having laterally spaced and vertically disposed sides, a top and a normally upright back all secured together to form a hood open on its frontal side, pivot means for pivotally mounting a rearward end of each side of said canopy frame on a rearward and upper end of a respective one of the sides of said base frame for permitting said canopy frame to be moved through an infinite number of positions between its normal upright position to form a seating arrangement and a fully lowered position placing the back of said canopy frame in at least general horizontal alignment with the top of said base frame to form a bed, and combined holding and locking means pivotally interconnected, forwardly of said pivot means, between a lower forward end of each of the sides of said canopy frame and a respective side of said base frame for selectively and releasably holding and locking said canopy frame in a selected lowered position between its upright and fully lowered positions.

2. The sheltering lounge chair of claim 1 wherein said base frame is mounted on a plurality of casters and further comprising releasable holding means for selectively holding said lounge on a stationery surface and against movement on said casters.

3. The sheltering lounge chair of claim 1 further comprising combined cushioning and return means for cushioning movement of said canopy frame when it is moved from its upright position towards its fully lowered position and for automatically moving said canopy frame in a controlled manner from its selected position to its upright position in response to release of said holding and locking means.

4. The sheltering lounge chair of claim 1 further comprising combined cushioning and return means pivotally interconnected, rearwardly of said pivot means, adjacent to each side of said canopy frame and said base frame for cushioning movement of said canopy frame when it is moved from its upright position towards its fully lowered position and for automatically moving said canopy frame in a controlled manner from its selected position to its upright position in response to release of said holding and locking means.

5. The sheltering lounge chair of claim 1 or 4 further comprising operator-control means mounted within said canopy frame for ready access to a person therein for selectively releasing said holding and locking means.

6. The sheltering lounge chair of claim 1 or 4 wherein a center of gravity of said canopy frame is positioned forwardly of said pivot means when said canopy frame is in its upright position and rearwardly of said pivot means when said canopy frame is in its fully lowered position.

7. The sheltering lounge chair of claim 1 or 4 wherein the sides, top and back of said canopy frame are each covered with a material exhibiting a basket weave and wherein said sides comprise a pair of laterally spaced and parallel side rails positioned forwardly thereon and the material covering the back of said canopy frame is suspended in multiple strip form from said side rails and extends continuously in suspended relationship over the sides and back of said canopy from said side rails to provide a hammock-like suspension when said canopy frame is in its fully lowered position.

8. The sheltering lounge chair of claim 4 wherein each side of said base frame has a steel reinforcing first member secured thereon and wherein said holding and locking means is pivotally mounted on said first member.

9. The sheltering lounge chair of claim 8 wherein each side of said canopy frame has a steel reinforcing second member secured thereon and wherein said cushioning and return spring means is pivotally interconnected between said first and second members.

10. The sheltering lounge chair of claim 1 wherein said holding and locking means comprises a housing pivotally mounted on a respective side of said base frame and a rod movably mounted in said housing and having an end thereof pivotally connected to a respective side of said canopy frame.

11. The sheltering lounge chair of claim 10 wherein said rod is movably mounted in said housing and said holding and locking means further comprises lock means engageable with said rod for selectively holding said rod in a selected position within said housing to control the selected position of said canopy frame on said base frame.

12. The sheltering lounge chair of claim 11 further comprising operator-control means, including an operator-control mounted in said canopy, for selectively actuating and releasing said holding and locking means to reposition said rod relative to said housing.

13. The sheltering lounge chair of claim 11 wherein said lock means comprises coil spring means mounted on said rod and in said housing for normally applying torsional friction and a gripping force to said rod to hold it in a selected reciprocal position relative to said housing and for releasing said gripping force when said spring is expanded circumferentially in response to selective manipulation of said operator-control.

14. The sheltering lounge chair of claim 13 wherein said operator-control is reciprocally mounted on said canopy frame and wherein said operator-control means further comprises a flexible actuating cable means for selectively actuating said holding and locking means to release the gripping force on said spring means in response to selective reciprocation of said operator-control.

15. The sheltering lounge chair of claim 14 wherein said operator-control means further comprises a collar rotatably mounted on said rod and having a lever extending radially outwardly therefrom, said cable means connected to said lever to rotate said collar on said rod to release said gripping force in response to pivoting of said lever.

16. The sheltering lounge chair of claim 11 wherein said rod has first screw threads formed thereon and said lock means comprises a gear rotatably mounted in said housing and having second screw threads engaged with the first screw threads of said rod and operator-control means for selectively rotating said gear to reposition said rod relative to said housing.

17. The sheltering lounge chair of claim 16 wherein said operator-control means comprises cable means for rotating said pinion gear, reversible motor means for rotating said cable means in either direction and switch means for selectively energizing said motor means to rotate said cable means and said gear in either direction to raise or lower said canopy frame on said base frame.

18. A sheltering lounge chair usable for sun bathing and the like comprising a base frame having laterally spaced and vertically disposed sides and a horizontally disposed top adapted to retain a seating cushion thereon, a normally upright canopy frame having laterally spaced and vertically disposed sides, a top and a normally upright back all secured together to form a hood open on its frontal side, pivot means for pivotally mounting a rearward end of said canopy frame on a rearward and upper end of said base frame for permitting said canopy frame to be moved through an infinite number of positions between its normal upright position to form a seating arrangement and a fully lowered position placing the back of said canopy frame in at least general horizontal alignment with the top of said base frame to form a bed, and combined holding and locking means interconnected between said canopy frame and said base frame for selectively and releasably holding and locking said canopy frame in a selected lowered position between its upright and fully lowered positions.

* * * * *